US008126646B2

(12) United States Patent
Grove et al.

(10) Patent No.: US 8,126,646 B2
(45) Date of Patent: Feb. 28, 2012

(54) PERFORATING OPTIMIZED FOR STRESS GRADIENTS AROUND WELLBORE

(75) Inventors: Brenden M. Grove, Missouri City, TX (US); Ian C. Walton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 334 days.

(21) Appl. No.: 11/162,195

(22) Filed: Aug. 31, 2005

(65) Prior Publication Data

US 2007/0050144 A1 Mar. 1, 2007

(51) Int. Cl.
*G01V 1/00* (2006.01)
*G06F 19/00* (2006.01)

(52) U.S. Cl. ..... 702/6; 175/50; 702/11

(58) Field of Classification Search ..... 166/55, 166/55.1, 55.2, 63, 250.01, 250.1, 297, 298, 166/299, 307, 308.1, 244.1, 305.1; 175/2, 175/4.51, 4.53, 40, 50; 702/1, 2, 6, 11
See application file for complete search history.

(56) References Cited

U.S. PATENT DOCUMENTS 2,696,169 A * 12/1954 Lassiter, Jr. ..... 175/4.53
(Continued)

FOREIGN PATENT DOCUMENTS

EP 0474350 A1 11/1992
(Continued)

OTHER PUBLICATIONS

"Choosing a Perforation Strategy": Oilfield Review, Oct. 1992, pp. 54-69.*

(Continued)

*Primary Examiner* — Edward Cosimano

(57) ABSTRACT

A technique includes determining a stress tensor in a formation that surrounds a wellbore. The stress tensor varies with respect to the wellbore. The technique includes running a perforating charge into the wellbore to perforate the formation and performing at least one of selecting the perforating charge and orienting the perforating charge in the wellbore based at least in part on the determination of the stress tensor.

17 Claims, 3 Drawing Sheets

U.S. PATENT DOCUMENTS

| | | | | | |
|---|---|---|---|---|---|
| 2,838,116 | A | * | 6/1958 | Clark, Jr. et al. | 166/308.1 |
| 2,923,358 | A | * | 2/1960 | Hildebrandt | 166/113 |
| 3,028,914 | A | * | 4/1962 | Flickinger | 166/284 |
| 3,050,118 | A | * | 8/1962 | Elkins | 166/297 |
| 3,058,521 | A | * | 10/1962 | Gilbert | 166/308.2 |
| 3,101,051 | A | * | 8/1963 | Gilbert | 175/4.6 |
| 3,118,501 | A | * | 1/1964 | Kenley | 175/4.52 |
| 3,313,348 | A | * | 4/1967 | Huitt et al. | 166/297 |
| 3,419,070 | A | * | 12/1968 | Ernst | 166/253.1 |
| 4,220,205 | A | * | 9/1980 | Coursen et al. | 166/299 |
| 4,552,234 | A | * | 11/1985 | Revett | 175/4.6 |
| 4,625,795 | A | * | 12/1986 | Despax et al. | 166/66 |
| 4,669,646 | A | | 6/1987 | Oinonen | |
| 4,744,245 | A | * | 5/1988 | White | 73/152.58 |
| 4,953,137 | A | * | 8/1990 | Medlin | 367/31 |
| 4,977,961 | A | * | 12/1990 | Avasthi | 166/297 |
| 5,010,964 | A | * | 4/1991 | Cornette | 175/4.51 |
| 5,074,359 | A | * | 12/1991 | Schmidt | 166/280.1 |
| 5,318,123 | A | * | 6/1994 | Venditto et al. | 166/250.1 |
| 5,335,724 | A | * | 8/1994 | Venditto et al. | 166/298 |
| 5,360,066 | A | * | 11/1994 | Venditto et al. | 166/250.1 |
| 5,381,690 | A | * | 1/1995 | Kanduth et al. | 73/152.54 |
| 5,386,875 | A | | 2/1995 | Venditto | |
| 5,443,119 | A | | 8/1995 | Chambers | |
| 5,517,854 | A | | 5/1996 | Plumb et al. | |
| 5,765,642 | A | * | 6/1998 | Surjaatmadja | 166/297 |
| 6,135,205 | A | * | 10/2000 | Phillips | 166/297 |
| 6,173,773 | B1 | * | 1/2001 | Almaguer et al. | 166/255.2 |
| 6,283,214 | B1 | | 9/2001 | Guinot et al. | |
| 6,508,307 | B1 | | 1/2003 | Almaguer | |
| 6,827,144 | B2 | | 12/2004 | Nicholson | |
| 6,834,233 | B2 | * | 12/2004 | Economides et al. | 702/1 |
| 7,006,918 | B2 | * | 2/2006 | Economides et al. | 702/1 |
| 7,159,660 | B2 | * | 1/2007 | Justus | 166/308.1 |
| 7,735,551 | B2 | * | 6/2010 | Vozniak et al. | 166/177.5 |
| 7,751,979 | B2 | * | 7/2010 | Molenaar | 702/11 |
| 2003/0042018 | A1 | * | 3/2003 | Huh et al. | 166/249 |
| 2003/0150263 | A1 | * | 8/2003 | Economides et al. | 73/152.48 |
| 2005/0065730 | A1 | | 3/2005 | Sinha | |
| 2005/0234648 | A1 | * | 10/2005 | Economides et al. | 702/6 |
| 2007/0000666 | A1 | * | 1/2007 | Vozniak et al. | 166/308.1 |
| 2009/0192716 | A1 | * | 7/2009 | Molenaar | 702/11 |

FOREIGN PATENT DOCUMENTS

| | | | |
|---|---|---|---|
| GB | 2352259 | A | 1/2001 |
| RU | 2079643 | C1 | 5/1997 |

OTHER PUBLICATIONS

"Perforating Practices that Optimize Productivity": Oilfield Review, Spring 2000, pp. 52-74.*

Almaguer et al: "Orienting Perforations in the Right Direction", Oilfield Review, Spring 2002, pp. 16-31.*

Acock et al: "Screenless Method to Control Sand", Oilfield Review, Spring 2003, pp. 38-53.*

* cited by examiner

PERFORATING OPTIMIZED FOR STRESS GRADIENTS AROUND WELLBORE

BACKGROUND

The invention generally relates to perforating that is optimized for stress gradients around the wellbore.

For purposes of producing well fluid from a formation, the formation typically is perforated from within a wellbore to enhance fluid communication between the reservoir and the wellbore. In the perforating operation, a perforating gun typically is lowered downhole (on a string, for example) inside the wellbore to the region of the formation to be perforated. The perforating gun typically contains perforating charges (shaped charges, for example) that are arranged in a phasing pattern about the longitudinal axis of the gun and are radially oriented toward the wellbore wall. After the perforating gun is appropriately positioned, the perforating charges are fired to pierce the well casing (if the well is cased) and produce radially extending perforation tunnels into the formation.

The formation is subject to tectonic forces, which produce stress on the formation. The stress has multidirectional components, one of which is a maximum horizontal stress. Quite often, the perforating charges are generally aligned with the direction of maximum horizontal stress for purposes of avoiding sand production and/or preparing the formation for subsequent fracturing operations.

SUMMARY

In an embodiment of the invention, a technique includes determining a stress tensor in a formation that surrounds a wellbore. The stress tensor varies with respect to the wellbore. The technique includes running a perforating charge into the wellbore to perforate the formation and performing at least one of selecting the perforating charge and orienting the perforating charge in the wellbore based at least in part on the determination of the stress tensor.

In another embodiment of the invention, a technique includes determining a stress tensor in a formation that surrounds a wellbore and based on the determination of the stress tensor, modeling formation damage near the wellbore. The formation damage that is predicted by the model varies with respect to the wellbore. The technique includes running a perforating charge into the wellbore to perforate the formation and orienting the perforating charge based at least in part on the model.

Advantages and other features of the invention will become apparent from the following description, drawing and claims.

DETAILED DESCRIPTION

Figure 1:
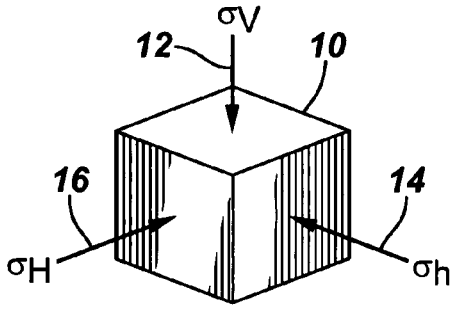
FIG. 1 is an illustration of principal components of a stress tensor according to an embodiment of the invention.

FIG. 1 depicts an infinitesimal unit 10 of a reservoir rock, or formation. The formation is subject to tectonic forces that produce stress gradients in the formation. The stress on the unit 10 may be characterized by a stress tensor that has three independent principal stress components, which generally differ in magnitude: a vertical, or overburden stress component 12 (called "$\sigma_V$" in FIG. 1); a minimum horizontal stress component 14 (called "$\sigma_h$" in FIG. 1); and a maximum horizontal stress component 16 (called "$\sigma_H$") in FIG. 1.

For purposes of producing well fluid from the formation, a wellbore is drilled into the formation. Neglecting the stress concentrations that are induced by the wellbore itself, the mean total stress (to be defined subsequently) is identical in every azimuthal direction around the wellbore. However, the direction of the stress tensor varies with respect to the azimuth. In the context of this application, references to "azimuth," "azimuthal" and the like mean a particular angular orientation with respect to the longitudinal axis of the wellbore.

Figure 2:
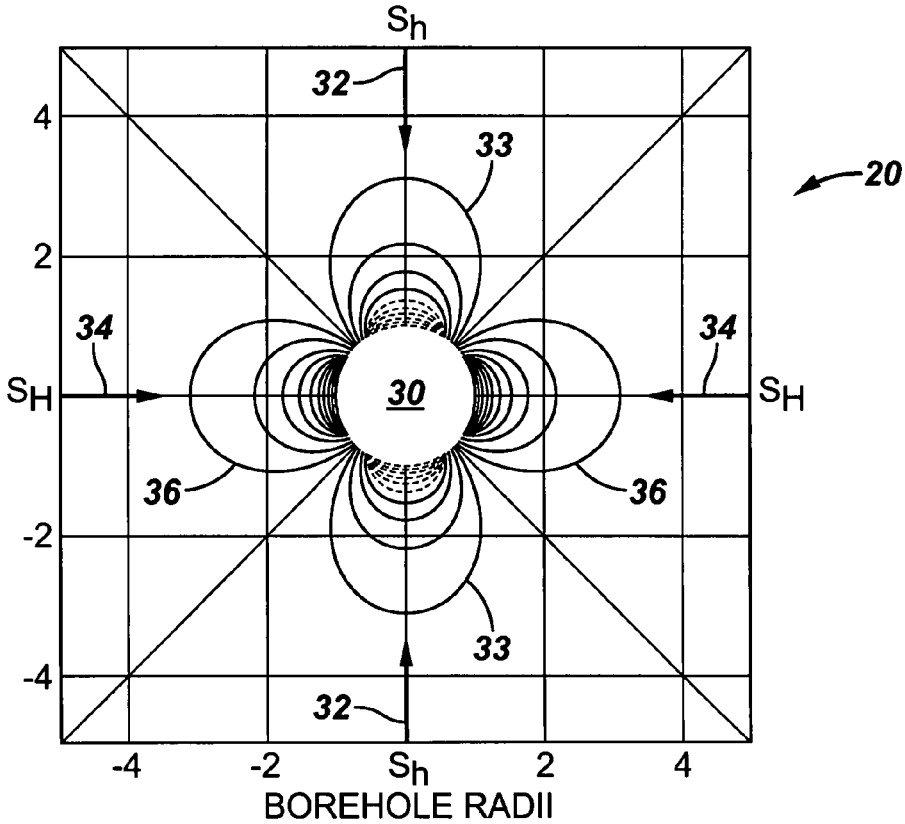
FIG. 2 is a cross-section of a wellbore, illustrating stress concentrations in the formation that surrounds the wellbore according to an embodiment of the invention.

The wellbore induces stress concentrations in the formation near the wellbore. As a more specific example, FIG. 2 is a cross-sectional view of an exemplary wellbore 30, depicting stress concentrations 20 about the wellbore 30. As depicted in FIG. 2, along an axis that is oriented with respect to maximum horizontal stress components 34, the formation surrounding the wellbore 30 has pronounced magnitude stress lobes 36, indicating stress decrease relative to far field values. Similarly, along an axis that is aligned with minimum horizontal stress components 32, the formation exhibits pronounced stress lobes 33, indicating stress increase relative to far field values. Between the lobes 33 and 36, stress approaches the far field value, as indicated by the stress concentrations approaching unity. Thus, near a wellbore, the total stress magnitude azimuthally varies. In general, the penetration depth of a perforating charge depends on the target rock's strength and in-situ stress. Conventionally, penetration depth has been gauged as being related to the effective stress of the formation. The effective stress is derived from the mean total stress, which is described below:

$$Stress_{mean\ total} = \frac{1}{3} \cdot (\sigma_v + \sigma_H + \sigma_h) \qquad \text{Equation 1}$$

where "$\sigma_V$," "$\sigma_H$," and "$\sigma_h$" represent the overburden, maximum horizontal and minimum horizontal principal stress components, respectively. From the mean total stress, the effective stress may be derived as follows:

Equation 2

$$\text{Stress}_{effective} = \text{Stress}_{meantotal} = \text{alpha} \cdot \text{fluid pore pressure}$$

where "alpha" is Biot's constant and is generally equal to or slightly less than unity.

Conventionally, the effective stress, a scalar quantity, is calculated and has a general correspondence to a perforating penetration depth, as described in pending U.S. patent application Ser. No. 11/162,185 entitled, "PERFORATING A WELL FORMATION," filed on Aug. 31, 2005, having Brenden M. Grove as the inventor.

It has been discovered, however, that perforating charge performance may be further enhanced by considering the specific stress tensor, not just the mean total stress. In other words, it has been discovered that the performance of a perforating charge may be enhanced by considering the stress tensor for the region of the formation, which is being perforated by the charge.

Figure 3:
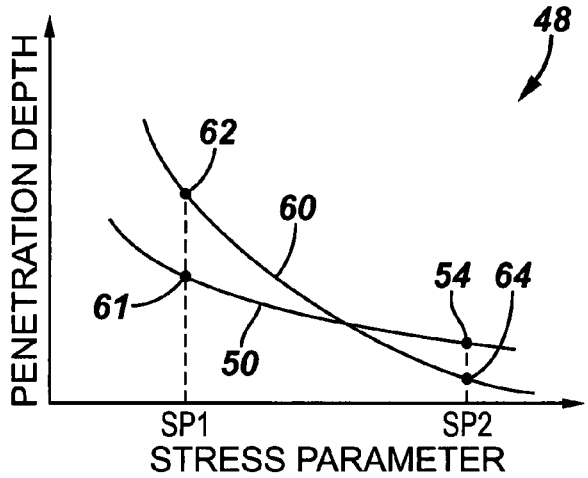
FIG. 3 depicts the performances of different perforating charges versus a stress parameter according to an embodiment of the invention.

For a particular stress tensor, one perforating charge may outperform other perforating charges. For example, FIG. 3 depicts a perforating charge performance chart 48 for a given formation stress tensor type or category. Thus, the chart 48 may be used for cases in which the stress tensor for the targeted formation region falls within a certain directional or magnitude range. The chart 48 includes, by way of example, a relationship 50 for a particular perforating charge, depicting the penetration depth of the charge versus a particular stress parameter. Likewise, FIG. 3 depicts an exemplary relationship 60 for another perforating charge (i.e., a perforating charge of a different type), depicting the penetration of that perforating charge versus the stress parameter.

It is understood that many different types of perforating charges are available due to variations in liner geometries, variations in liner materials, variations in charge explosive compositions, variations in charge casing geometries, variations in charge case materials, variations in casing cap designs, variations in casing cap materials, etc.

The "stress parameter" of the chart 48 of FIG. 3 may be one of a number of different parameters, depending on the particular embodiment of the invention. For example, in some embodiments of the invention, the stress parameter may be the mean total stress for a particular stress tensor and thus, may be average of its vertical, minimum horizontal and maximum horizontal principal components. As another example, in other embodiments of the invention, the stress parameter of FIG. 3 may be an average of only two of the principal stress components; and as yet another example, in some embodiments of the invention, the stress parameter may be one of the principle stress components, such as the maximum horizontal stress component (as an example). Many other variations are possible and are within the scope of the appended claims.

Regardless of the technique that is used to calculate the stress parameter, different perforating charge types have different penetration performances versus the stress parameter. Thus, as shown in FIG. 3 by way of example, for a first given stress parameter (called "SP1," in FIG. 3), a penetration depth 62 of the relationship 60 is greater than a corresponding penetration depth 61 of the relationship 50. Therefore, if the targeted formation region exhibits the stress parameter SP1, then the perforating charge that corresponds to the relationship 60 is chosen, as the perforating charge has the greater penetrating depth.

It is noted, however, that the perforating charge type that corresponds to the relationship 50 may be chosen in other applications. Thus, as depicted in FIG. 3, if the targeted formation region exhibits another exemplary stress parameter (called "SP2," in FIG. 3), the relationship 50 depicts a larger penetration depth 54 than a corresponding penetration depth 64 that is depicted by the relationship 60. Therefore, for this particular application, the perforating charge type that corresponds to the relationship 50 is chosen.

Therefore, the perforating charge that is selected depends on a particular stress parameter for the targeted formation region. Furthermore, the azimuthal directions of the perforating charges of a perforating gun may be selected to aim the perforating charges toward regions of the formation where perforation depth is maximized. Thus, empirical tests may be conducted to produce charts, such as the chart 48 that is depicted in FIG. 3, for purposes of detecting which stress tensors are desired for optimizing perforating performance. Therefore, knowledge of the stress tensor may be used to select such parameters as the perforating charge type, orientation of the perforating charge, the carrier used to convey the perforating charge downhole, etc.

Figure 4:
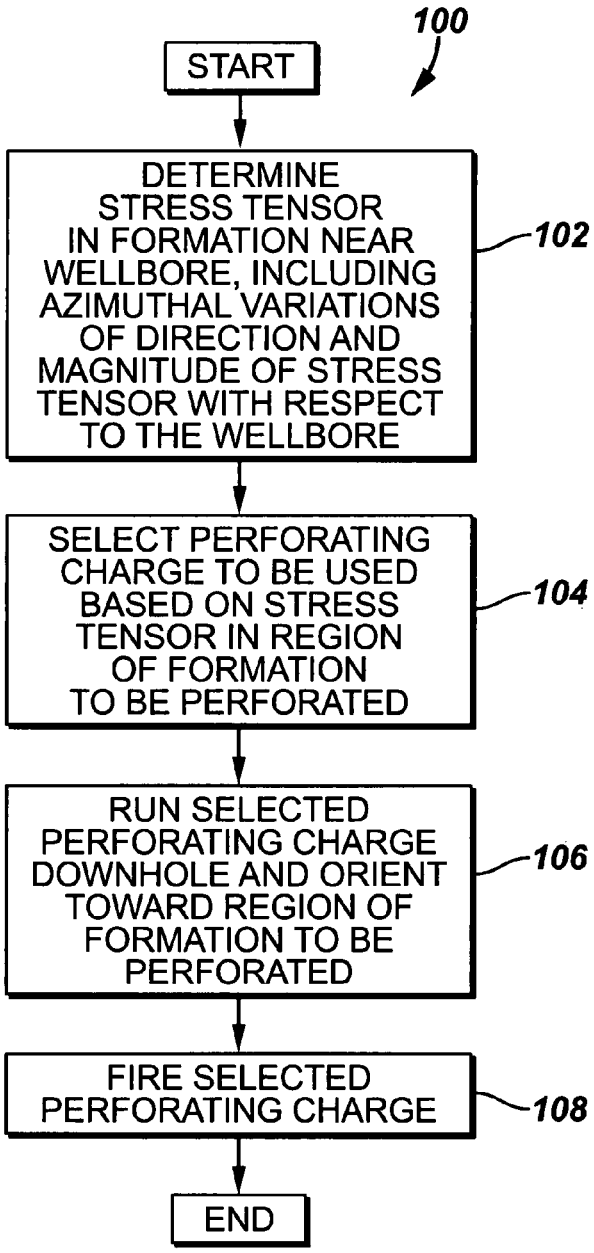
FIG. 4 is a flow diagram depicting a technique to select and orient a perforating charge based on a stress tensor according to an embodiment of the invention.

To summarize, in general, FIG. 4 depicts a technique 100 in accordance with some embodiments of the invention. The technique 100 includes determining (block 102) a stress tensor in a formation near a wellbore. The stress tensor azimuthally varies in direction and magnitude with respect to the wellbore. It is noted that the stress tensor may also and/or alternatively vary longitudinally with respect to the wellbore (i.e., vary along the longitudinal axis of the wellbore). The stress tensor may be calculated or at least estimated by knowledge of tectonic forces. Next, in accordance with the technique 100, a perforating charge is selected (block 104) based on the stress. The technique 100 includes running the selected perforating charge downhole and orienting the charge toward the region of the formation to be perforated, as depicted in block 106. The selected perforating charge is then fired, as depicted in block 108.

Knowledge of the stress tensor may be used for purposes other than the purpose of maximizing penetration depth. For example, in accordance with some embodiments of the invention, the knowledge of the stress tensor may be used for purposes of avoiding damaged regions of the well near the wellbore. In this regard, formation damage typically occurs near the wellbore due to fluid invasion, such as the invasion of drilling fluid. In general, more formation stress means less fluid invasion, and conversely, less stress means greater fluid invasion.

Figure 5:
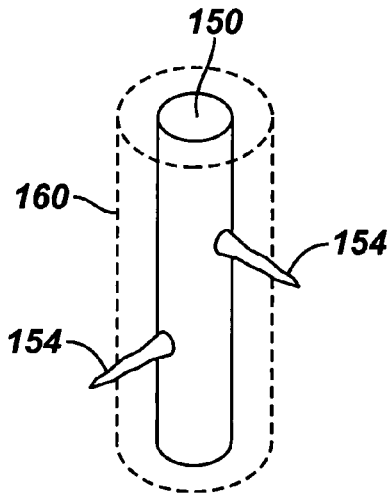
FIG. 5 (Prior Art)
FIG. 5 depicts a model of formation damage near a wellbore according to the prior art.

FIG. 5 depicts a model 160 of formation damage near an exemplary wellbore 150 according to the prior art. As shown, the model 160 is conventionally perceived to be generally uniform and thus, generally circularly cylindrical about the wellbore 150. Therefore, conventionally, regardless of the azimuthal orientation of perforating charges, the resulting perforation tunnels 154 are expected to experience the same depth of damaged formation.

Figure 6:
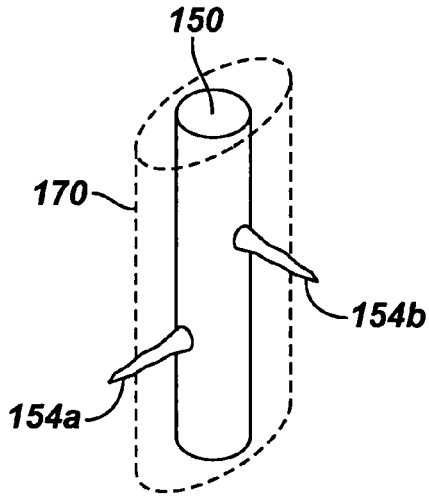
FIG. 6 illustrates a model of formation damage near a wellbore according to an embodiment of the invention.

However, the above-described conventional depiction of formation damage does not account for the perturbation of the formation stress due to the existence of the wellbore. Referring to FIG. 6, in accordance with some embodiments of the invention, the stress tensor is used to develop a formation damage model 170 that accounts for the anisotropic variation in stress around the wellbore 150. As depicted in FIG. 6, due to this anisotropic stress variation, the formation damage model 170 may be elliptically symmetrical (as an example), in some embodiments of the invention. Thus, depending on the azimuthal variation about the wellbore 150, the formation damage may be radially thinner in some directions than in other directions. For example, FIG. 6 depicts a perforation tunnel 154*a* that extends through more formation damage relative to a perforation tunnel 154*b* that extends through relatively a smaller amount of formation damage. Therefore, for this example, the perforation tunnel 154*a* is generally less effective than the perforation tunnel 154*b*. It is noted that the formation damage may likewise vary in a longitudinal direction along the wellbore.

Figure 7:
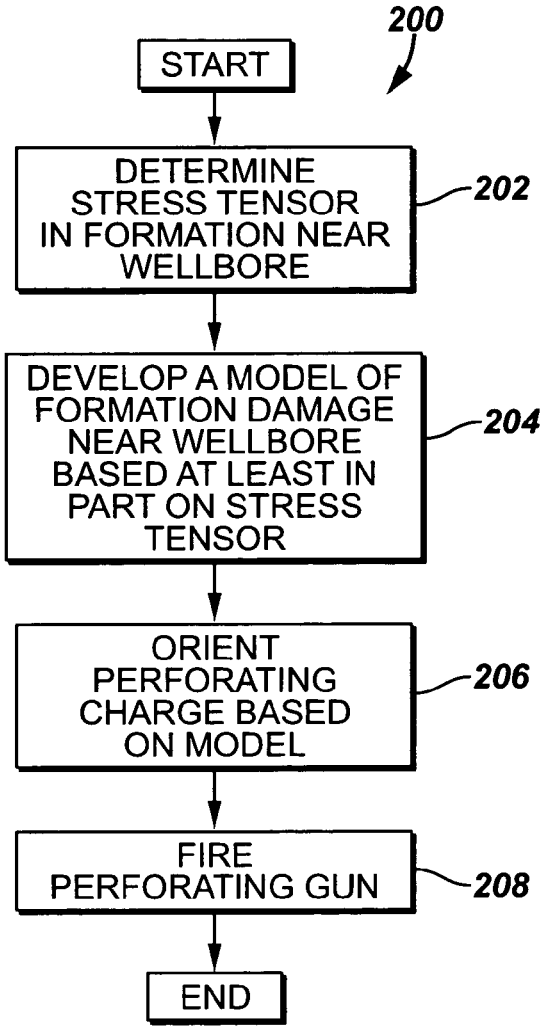
FIG. 7 is a flow diagram depicting a technique to orient a perforating charge based on a model of formation damage derived from a stress tensor determination according to an embodiment of the invention.

Thus, in accordance with some embodiments of the invention, the stress tensor is used to develop a formation damage model for purposes of optimizing perforation. More specifically, referring to FIG. 7, in accordance with some embodiments of the invention, a technique 200 generally includes determining (block 202) a stress tensor in a formation near a wellbore. Next, according to the technique 200, a model of formation damage near the wellbore is developed (block 204) based at least in part on the stress tensor. The perforating charge is then oriented based on the model, as depicted in block 206. Subsequently, once in this orientation and positioned in the segment of the well to be perforated, the perforating charge may then be fired.

As yet another variation, in accordance with other embodiments of the invention, the type of perforating charge that is selected may be based on the above-described formation damage model and azimuthal direction of perforation. Thus, similar to the techniques that are described above, performance charts (charts that graph penetration depth versus stress parameters) may be used to select the perforating charges for a given application.

Figure 8:
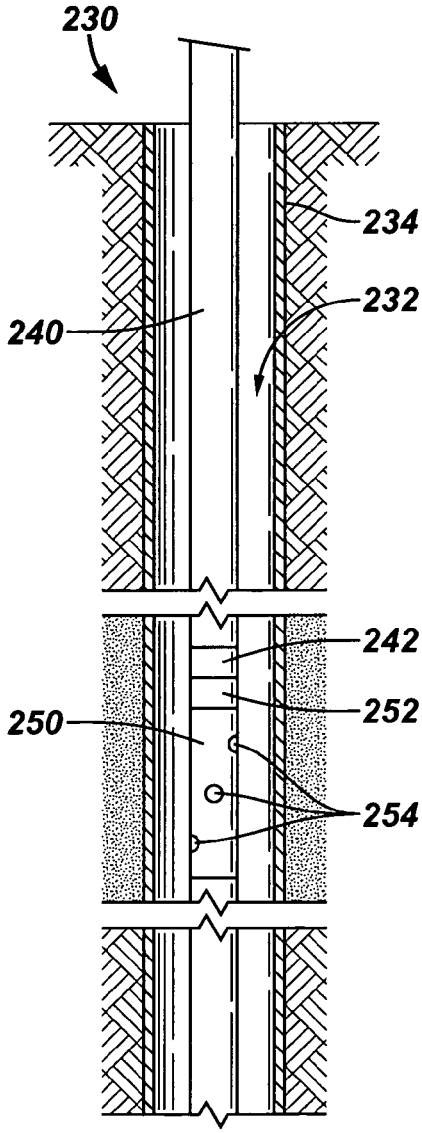
FIG. 8 is a schematic diagram of a well according to an embodiment of the invention.

FIG. 8 generally depicts a perforating system according to some embodiments of the invention. Referring to FIG. 8, in accordance with some embodiments of the invention, the system is used in a well 230, which includes an exemplary vertical wellbore 232. A string 240 of the perforating system extends into the wellbore 232 for purposes of penetrating a casing string 234 and the surrounding formation of the wellbore 232. Although FIG. 8 depicts the wellbore 232 as being cased, it is noted that the perforating system may be likewise used in an uncased wellbore, in other embodiments of the invention. Furthermore, although FIG. 8 depicts a vertical wellbore 232, it is noted that the perforating system may be used in a lateral or horizontal wellbores in other embodiments of the invention.

The string 240 includes a perforating gun 250 that includes a firing head 252 and perforating charges 254 (shaped charges, for example). The particular phasing of the shaped charges 254, as well as the type of the perforating charges 254 are selected based on stress tensor of the formation region to be perforated, as described above. For purposes of orienting the perforating charges 254, the string 240 includes an orientation mechanism 242.

Depending on the particular embodiment of the invention, all of the perforating charges 254 may be the same, groups of the perforating charges 254 may be the same type, or all of the perforating charges 254 may be different types. Thus, many variations are possible and are within the scope of the appended claims. Furthermore, in accordance with the particular embodiment of the invention, the selection of the carrier for the perforating charges 254 and the phasing pattern for the perforating charges 254 depends on the determined stress tensor in the formation being perforated. Likewise, in some embodiments of the invention, a particular region of the formation may be targeted, and thus, the perforation orientation may target this region.

Although FIG. 8 depicts that the perforating gun 250 is lowered downhole on a string, other conveyance mechanisms may be used, in other embodiments of the invention. In this regard, depending on the particular embodiment of the invention, the perforating charge 250 may be lowered downhole via a wireline, a slickline, coiled tubing, etc.

The firing head 252 may be hydraulically, mechanically or electrically operated, depending on the particular embodiment of the invention. Furthermore, various techniques may be used to establish communication between the firing head 252 and the surface of the well. Thus, a wired connection (an optical or electrical cable, as examples) may be established between the firing head 252 and the surface of the well. Alternatively, a wireless communication path (i.e., a communication path that uses pressure pulses, electromagnetic communication, acoustic communication, etc.) may be used to establish communication between the firing head 252 and the surface of the well. Other variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a wellbore, comprising:

determining a stress tensor in a formation that surrounds a wellbore;

based on the determination of the stress tensor, modeling formation damage due to the process of drilling near the wellbore, the formation damage predicted by the model varying with respect to the wellbore;

running a perforating charge into the wellbore to perforate the formation; and orienting the perforating charge based at least in part on the model.

2. The method of claim 1, wherein the model varies azimuthally with respect to the wellbore.

3. The method of claim 1, wherein a direction of the stress tensor varies azimuthally with respect to the wellbore.

4. The method claim 1, wherein a magnitude of the stress tensor varies azimuthally with respect to the wellbore.

5. The method of claim 1, wherein the stress tensor includes a vertical principal stress component, a minimum horizontal stress component and a maximum horizontal stress component.

6. The method of claim 1, wherein the orienting comprises selecting a phasing pattern for a perforating gun.

7. The method of claim 1, wherein the orienting comprises selecting a carrier for the perforating charge.

8. The method of claim 1, wherein the orienting comprises aiming the perforating charge to select a region of the formation for which the perforating charge is optimized for penetration.

9. The method of claim 1, wherein the formation damage is caused at least in part by drilling mud invasion.

10. The method of claim 9, wherein the drilling mud invasion is a function of the stress tensor.

11. A system usable with a wellbore, comprising a perforating gun adapted to be lowered downhole in the wellbore to perforate a formation that surrounds the wellbore; and a perforating charge located in the perforating gun and oriented with respect to the well bore based on a determined damage zone of the formation due to the process of drilling near the well bore, the damaged zone varying with respect to the well bore and the determination of the damaged zone being based at least in part on a determination of a stress tensor that surrounds the wellbore.

12. The system of claim 11, wherein the damaged zone varies azimuthally with respect to the wellbore.

13. The system of claim 11, wherein a direction of the stress tensor varies azimuthally with respect to the wellbore.

14. The system of claim 11, wherein a magnitude of the stress tensor varies azimuthally with respect to the wellbore.

15. The system of claim 11, wherein the stress tensor includes a vertical principal stress component, a minimum horizontal stress component and a maximum horizontal stress component.

16. The system of claim 11, wherein the damaged zone comprises a region of the formation damaged at least in part by drilling mud invasion.

17. The system of claim 16, wherein the drilling mud invasion is a function of the stress tensor.

* * * * *